US010655589B2

(12) United States Patent
Cwik et al.

(10) Patent No.: US 10,655,589 B2
(45) Date of Patent: May 19, 2020

(54) METHOD FOR MESHING A STARTING PINION WITH A TOOTHED RING OF AN INTERNAL COMBUSTION ENGINE

(75) Inventors: Matthias Cwik, Stuttgart (DE); Markus Roessle, Stuttgart (DE); Ewald Mauritz, Weissach (DE); Stefan Tumback, Stuttgart (DE)

(73) Assignee: SEG Automotive Germany GmbH, Stuttgart (DE)

( * ) Notice: Subject to any disclaimer, the term of this patent is extended or adjusted under 35 U.S.C. 154(b) by 1350 days.

(21) Appl. No.: 13/577,687

(22) PCT Filed: Feb. 10, 2011

(86) PCT No.: PCT/EP2011/051922

§ 371 (c)(1),
(2), (4) Date: Oct. 12, 2012

(87) PCT Pub. No.: WO2011/098503

PCT Pub. Date: Aug. 18, 2011

(65) Prior Publication Data

US 2013/0041572 A1 Feb. 14, 2013

(30) Foreign Application Priority Data

Feb. 10, 2010 (DE) ..... 10 2010 001 773

(51) Int. Cl.
*F02N 11/08* (2006.01)

(52) U.S. Cl.
CPC .. *F02N 11/0855* (2013.01); *F02D 2200/0406* (2013.01); *F02N 2200/022* (2013.01);
(Continued)

(58) Field of Classification Search
CPC .. F02N 11/08; F02N 11/0851; F02N 11/0855; F02N 2200/021; F02N 2200/022; F02N 2300/2008
See application file for complete search history.

(56) References Cited

U.S. PATENT DOCUMENTS 7,275,509 B2 10/2007 Kassner
2005/0228575 A1 10/2005 Murakami et al.
(Continued)

FOREIGN PATENT DOCUMENTS

FR 2925616 6/2009
JP 2008215154 9/2008
(Continued)

OTHER PUBLICATIONS

International Search Report for Application No. PCT/EP2011/051922 dated Sep. 15, 2011 (English Translation and Original, 6 pages).

*Primary Examiner* — Sizo B Vilakazi
*Assistant Examiner* — Anthony L Bacon
(74) *Attorney, Agent, or Firm* — Michael Best & Friedrich LLP

(57) ABSTRACT

The invention relates to a method for actuating a starter device (10), wherein the starter device (10) comprises a starting pinion (22) which is to be meshed with a toothed ring (25) of an internal combustion engine (210), the internal combustion engine (210) having a drive shaft (222). The invention is characterized in that a) first a rotational speed (n, n1, n2, n3) of the drive shaft (222) is determined, b) said rotational speed (n, n1, n2, n3) is then compared to a predefined rotational speed value (nG), and c) in the case that the rotational speed (n, n1, n2, n3) is less than or equal to the predefined rotational speed value (nG), the starting pinion (22) is toed in the direction of the toothed ring (25).

18 Claims, 6 Drawing Sheets

(52) U.S. Cl.
CPC . *F02N 2200/023* (2013.01); *F02N 2300/2011* (2013.01); *Y10T 74/131* (2015.01)

(56) References Cited

U.S. PATENT DOCUMENTS

| | | | | |
|---|---|---|---|---|
| 2007/0137602 | A1* | 6/2007 | Kassner | 123/179.25 |
| 2009/0020091 | A1 | 1/2009 | Botzenhard et al. | |
| 2009/0224557 | A1 | 9/2009 | Reynolds et al. | |
| 2010/0050970 | A1* | 3/2010 | Okumoto et al. | 123/179.4 |
| 2010/0132647 | A1* | 6/2010 | Dietrich | 123/179.3 |
| 2010/0180849 | A1* | 7/2010 | Senda et al. | 123/179.4 |
| 2010/0282199 | A1 | 11/2010 | Heyers et al. | |
| 2011/0118962 | A1* | 5/2011 | Couetoux et al. | 701/113 |
| 2011/0174255 | A1 | 7/2011 | Neuburger et al. | |
| 2011/0184626 | A1* | 7/2011 | Mauritz et al. | 701/102 |
| 2011/0246050 | A1 | 10/2011 | Roessle et al. | |
| 2012/0024253 | A1* | 2/2012 | Hartmann et al. | 123/179.25 |

FOREIGN PATENT DOCUMENTS

| | | | |
|---|---|---|---|
| WO | WO/2009/083477 | * | 9/2009 |
| WO | 2010/012764 | | 2/2010 |

* cited by examiner

METHOD FOR MESHING A STARTING PINION WITH A TOOTHED RING OF AN INTERNAL COMBUSTION ENGINE

BACKGROUND OF THE INVENTION

The invention relates to a method for actuating a starter device and here quite particularly the starting pinion of the starter device. It is provided here that this starting pinion is meshed with a dynamic or rotating or rotationally oscillating toothed ring of an internal combustion engine.

DE 10 2006 011 644 A1 has already disclosed a method which is intended to be used to mesh a starting pinion with a moving toothed ring.

SUMMARY OF THE INVENTION

The present solution aims to carry out the method even better and even more accurately and therefore to control the kinematic relationships between the starting pinion and the toothed ring even more precisely.

The method according to the invention permits a starter motor or the starting pinion of a starter motor to be meshed with the toothed ring of an internal combustion engine which is coasting to a standstill at a defined rotational speed. The rotational speed thresholds and the crankshaft angle thresholds which are used here make this method low in complexity since there is little expenditure required on the algorithmic treatment of the method. Furthermore, the number of input parameters which have to be taken into account is low, with the result that the computational expenditure can be kept low. Furthermore, the method is comparatively variable insofar as the meshing rotational speed is concerned. It is therefore possible to perform the meshing before, during or after the swingback of the internal combustion engine or of the crank drive of the internal combustion engine. Owing to the low-complexity algorithm, this method is quite particularly suitable if the internal combustion engine usually comes to a standstill very quickly. Coming to a standstill very quickly means that the angular speed of the drive shaft of the internal combustion engine or of the crankshaft of the internal combustion engine decreases particularly quickly and the internal combustion engine or its drive shaft therefore comes to a standstill particularly quickly. Owing to these properties of the internal combustion engine, a very rapid method sequence is necessary in order to be able to mesh the starting pinion in good time before the internal combustion engine comes to a standstill. The method proposed here is also suitable for meshing the starting pinion with an internal combustion engine swinging back. A swinging-back internal combustion engine means that, when the kinematic energy is low and there is a pneumatic spring in a combustion chamber which counteracts a rotational movement of the drive shaft (compression stroke), the drive shaft is no longer permitted a top dead center of a piston of the internal combustion engine to be reached and instead the pneumatic spring brings about a change in the rotational direction of the drive shaft.

The method is preferably aimed at calculating the anticipated profile of the coasting of the internal combustion engine to a standstill by means of devices which are already used in modern vehicles or internal combustion engines. These devices are, for example, control units which serve to control the internal combustion engine. Alternatively, the calculation can, of course, also be performed in separate control electronics. Owing to the method which is low in complexity, said method is, for example, quite particularly suitable when the size of electronic memories is limited, less powerful processors are used and only a small number of parameters are available.

Owing to the criterion according to which a rotational speed of the drive shaft is then used as a criterion in order to pre-engage a starting pinion of the starter device in the direction of the toothed ring, the method has proven particularly advantageous if this rotational speed is lower than a predefined rotational speed value which is acquired through experience. This rotational speed value is to be determined, for example, in a specific, previously determined position of the drive shaft. This specific position may be, for example, just after a position of the drive shaft at a bottom dead center, or at a bottom dead center or, for example, at a top dead center. Any desired other positions of the drive shaft can also be evaluated.

If it was detected within the scope of the method that at this specific position the drive shaft has an angular speed which is not higher than a predefined rotational speed value, according to the method the starting pinion is subsequently pre-engaged. This starting of pre-engagement may be made dependent, for example, on the fact that a further result occurs after a specific rotational position of the drive shaft has been determined or adopted. This may take the form, for example, of the drive shaft reaching, after this position, a specific further angular speed which then becomes a trigger for the actual meshing process. Alternatively, a time can also be selected as a trigger. This time may comprise, for example, a specific number of milliseconds, i.e. be a specific time period which has passed since the specific position of the drive shaft was adopted. According to a further alternative, this may also be, for example, another specific further angular position of the drive shaft. It is therefore possible, for example, to determine the angular speed of the drive shaft when this drive shaft or a piston coupled to the drive shaft adopts a top dead center, and starting from this angular position the next bottom dead center of this piston is reached, which is then a triggering condition (position of the drive shaft at this bottom dead center) for the initiation of the pre-engagement of the starting pinion.

According to a further refinement of the invention, there is provision that the event (starting rotational speed, starting time, starting angle) is determined as a function of at least one operating condition. This operating condition may be, for example, an engine load which is characterized, for example, by a thrust operation. A thrust operation would occur, for example, when the vehicle rolled down a slope, as it were, free of load. A further operating condition may also be, for example, the temperature of the cooling water of the internal combustion engine or a temperature of the lubricant of the internal combustion engine. Alternatively, this may also be, for example, an internal temperature of the engine compartment. Furthermore, for example the state of the engine oil of the internal combustion engine is also possible. The state of the engine oil influences, for example, the friction between a piston and a cylinder wall along which the piston rings slide or the piston slides. Particularly fresh oil gives rise, for example, to a low coefficient of friction between the piston and the cylinder wall, while relatively old oil gives rise to a higher level of friction between the cylinder wall and the piston. It is therefore possible to evaluate a signal of an oil state sensor in order to infer, for example, rather steep coasting of the drive shaft to a standstill (relatively old or old oil), while fresh oil gives rise to relatively flat coasting of the drive shaft to a standstill. A further operating condition may, for example, also be the pressure in an inflow section of the internal combustion engine. An inflow section is understood here to be, for example, an intake manifold insofar as the internal combustion engine is a self-induced engine. If the engine is a supercharged engine to which combustion air is fed by means of a pressure generator (turbocharger or the like, for example compressor), it is the pressure in the "pressure manifold" between the pressure generator and the combustion space which is significant. Of course, the individual parameters can also be combined with one another.

If a starting time or a time at which pre-engagement of the starting pinion is brought about is unequal to the angle whose adoption means that the drive shaft meets the condition which leads to pre-engagement of the starting pinion, there is provision that the further condition which is to be met (starting angle, starting time, starting rotational speed) is obtained from a characteristic diagram, and this further condition is stored as a function of the rotational speed which can be present at the specific angle.

There is provision that the starting time, which is preferably the time which coincides with the start of a flow of current through a pre-engagement actuator which leads, for example, to a thrust movement of a magnetic armature in the pre-engagement actuator. The time at which the starting pinion begins to move in the direction of the toothed ring can also be defined as the starting time. Furthermore, the starting time can be defined as the time at which an electric current in the pre-engagement actuator begins to build up an electrical magnetic field which brings about a thrust movement of the magnetic armature.

In order to obtain the most predictable possible rotational speed profile of the drive shaft of the internal combustion engine which is coasting to a standstill, there is provision that a position of a flow throttle which is located in the inflow section of the internal combustion engine is not changed. Otherwise, as a result of this, pre-engagement of the starting pinion which had already been brought about would bring about contact between the starting pinion and the toothed ring at an unsuitable time. If, for example, the abovementioned flow throttle was suddenly opened wide, this would have effects on the rotational speed profile and therefore on the time at which the starting pinion and the toothed ring would meet.

According to a further refinement of the invention, there is provision that, before the last top dead center is reached, the curve profile (rotational speed profile of the drive shaft) is determined, wherein a starting time or a starting criterion, which occurs before a top dead center of the crankshaft, is determined as a function of the steepness S of the curve.

BRIEF DESCRIPTION OF THE DRAWINGS

The invention will be explained in more detail below by way of example with reference to the figures, of which:

FIG. 3 to FIG. 12 show various examples of the drive shafts of an internal combustion engine coasting to a standstill as well as various possibilities for the determination of suitable meshing times.

DETAILED DESCRIPTION

Figure 1:
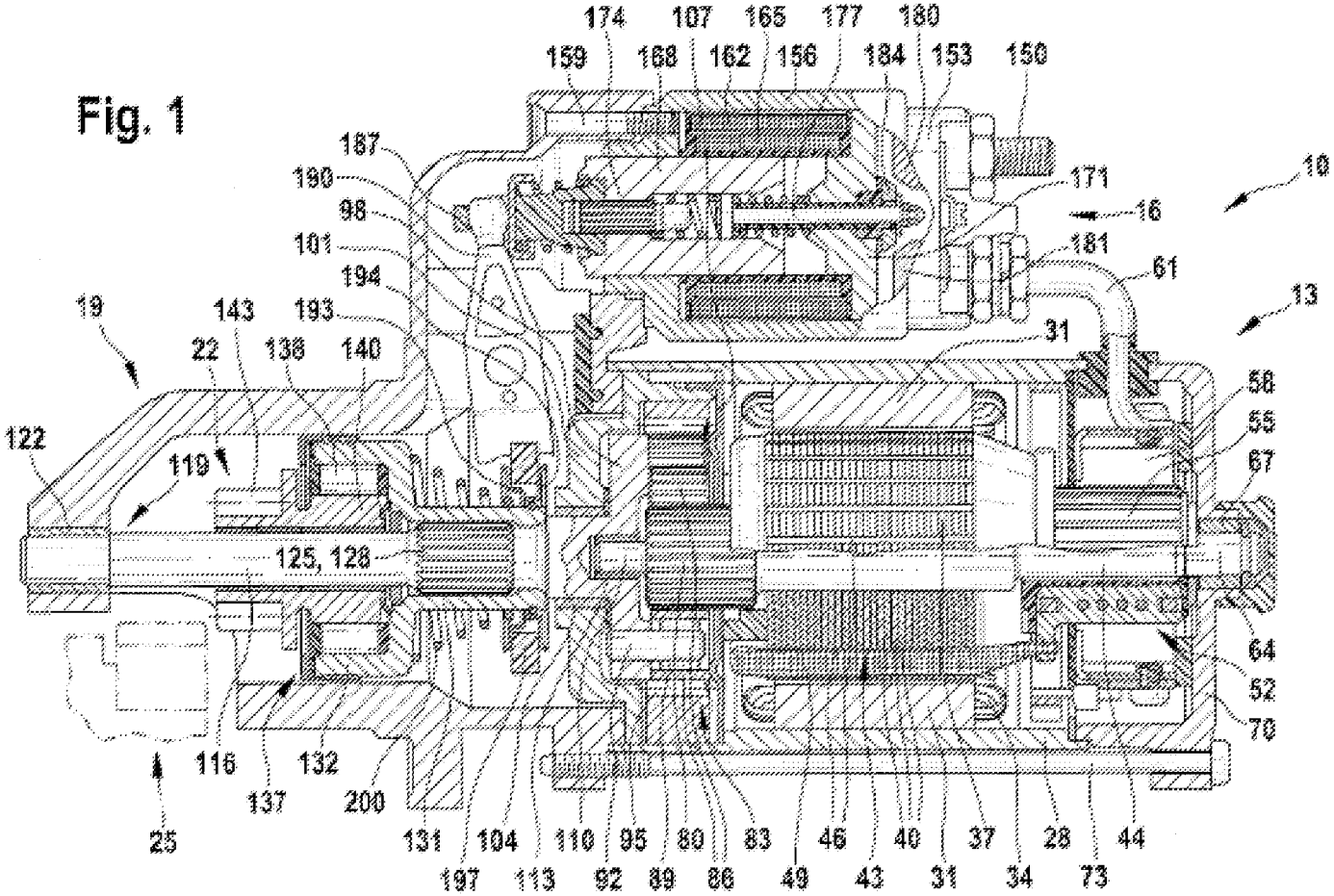
FIG. 1 shows a starter device in a longitudinal section.

FIG. 1 shows a starter device 10 in a longitudinal section. This starter device 10 has, for example, a starter motor 13 and an electric pre-engagement actuator 16 (relay, starter relay). The starter motor 13 and the electric pre-engagement actuator 16 are attached to a common drive end plate 19. The starter motor 13 serves functionally for driving a starting pinion 22 when it is meshed with the toothed ring 25 of the internal combustion engine (not illustrated here).

The starter motor 13 has as a housing a pole tube 28 which has on its inner circumference pole shoes 31 which each have an exciter winding 34 wound around them. The pole shoes 31 in turn surround an armature 37, which has an armature packet 43 constructed from laminations 40 and an armature winding 49 arranged in grooves 46. The armature packet 43 is pressed onto a drive shaft 44. Furthermore, a commutator 52, which is constructed, inter alia, from individual commutator laminations 55, is attached to the end of the drive shaft 13 facing away from the starting pinion 22. The commutator laminations 55 are electrically connected to the armature winding 49 in a known fashion such that when the commutator laminations 55 are energized by means of carbon brushes 58, a rotational movement of the armature 37 occurs in the pole tube 28. A power supply 61, arranged between the electric drive 16 and the starter motor 13, supplies, in the switched-on state, both the carbon brushes 58 and the exciter winding 34 with current. The drive shaft 13 is supported on the commutator side with a shaft stub 64 in a sliding bearing 67, which is in turn held in a positionally fixed fashion in a commutator bearing lid 70. The commutator lid 70 is in turn fastened by means of ties 73 (screws, for example 2, 3 or 4 thereof), which are arranged distributed over the circumference of the pole tube 28, in the drive end plate 19. In this context, the pole tube 28 is supported on the drive end plate 19 and the commutator bearing lid 70 is supported on the pole tube 28.

In the driving direction, the armature 37 is adjoined by what is referred to as a sun gear 80 which is part of a planetary gear mechanism 83. The sun gear 80 is surrounded by a plurality of planetary gears 86, usually three planetary gears 37 which are supported on axle stubs 92 by means of roller bearings 89. The planetary gears 37 roll in a ring gear 95, which is mounted on the outside in the pole tube 28. The planetary gears 37 are adjoined in the direction of the output side by a planetary carrier 98 in which the axle stubs 92 are accommodated. The planetary carrier 98 is in turn mounted in an intermediate bearing 101 and a sliding bearing 104 which is arranged therein. The intermediate bearing 101 is configured in a pot shape such that both the planetary carrier 98 and the planetary gears 86 are accommodated therein. Furthermore, the ring gear 95 is arranged in the pot-shaped intermediate bearing 101 and is ultimately closed off from the armature 37 by a lid 107. The intermediate bearing 101 is also supported with its outer circumference on the inside of the pole tube 28. The armature 37 has, on the end of the drive shaft 13 facing away from the commutator 52, a further shaft stub 110, which is also accommodated in a sliding bearing 113. The sliding bearing 113 is in turn accommodated in a central drill hole in the planetary carrier 98. The planetary carrier 98 is connected in one piece to the output shaft 116. This output shaft is supported, by its end 119 facing away from the intermediate bearing 101, in a further bearing 122 which is fastened in the drive end plate 19.

The output shaft 116 is divided into various sections: the section which is arranged in the sliding bearing 104 of the intermediate bearing 101 is therefore followed by a section with what is referred to as straight toothing 125 (internal toothing), which is part of what is referred to as a shaft/hub connection. In this case, this shaft/hub connection 128 permits a driver 131 to slide in an axially linear fashion. This driver 131 is a sleeve-like projection which is connected in one piece to a pot-shaped outer ring 132 of the freewheel 137. This freewheel 137 (one-way rotation device) is also composed of the inner ring 140, which is arranged radially inside the outer ring 132. Clamping bodies 138 are arranged between the inner ring 140 and the outer ring 132. These clamping bodies 138 prevent, through interaction with the inner ring and the outer ring, a relative rotation between the outer ring and the inner ring in a second direction. In other words: the freewheel 137 permits a circumferential relative movement between the inner ring 140 and the outer ring 134 only in one direction. In this exemplary embodiment, the inner ring 140 is embodied in one piece with the starting pinion 22 and the oblique toothing 143 thereof (external oblique toothing). The starting pinion 22 can alternatively also be embodied as a straight-toothed pinion. Instead of electromagnetically excited pole shoes 31 with an exciter winding 34, permanently magnetically excited poles could also be used. Instead of being equipped with straight toothing 125, the shaft/hub connection 128 can also be equipped with steep pitch toothing. In this context, combinations are possible according to which a) the starting pinion 22 has oblique toothing and the shaft/hub connection 128 has straight toothing 125, b) the starting pinion 22 has oblique toothing and the shaft/hub connection 128 has steep pitch toothing, or c) the starting pinion 22 has straight toothing and the shaft/hub connection 128 has steep pitch toothing.

However, the electric pre-engagement actuator 16 or the armature 168 also has the function of moving, with a traction element 187, a lever which is arranged in a rotationally movable fashion the drive end plate 19. This lever 190, usually embodied as a fork lever, engages with two "prongs" (not illustrated here) on its outer circumference around two disks 193 and 194 in order to move a driver ring 197, clamped in between the latter, toward the freewheel 137 counter to the resistance of the spring 200, and to cause the starting pinion 22 to mesh with the toothed ring 25.

Details will be given below on the meshing mechanism. The electric drive 16 has a bolt 150 which is an electric contact and, when it is installed in the vehicle, is connected to the positive pole of an electric starter battery (not illustrated here). This bolt 150 is guided through a lid 153. A second bolt 152 is a connection for the electric starter motor 13, which is supplied via the power supply 61 (thick stranded conductor). This lid 153 closes off a housing 156 which is made of steel and which is fastened to the drive end plate 19 by means of a plurality of fastening elements 159 (screws). A thrust device 160 for applying a tractive force to the fork lever 190 and a switching device 161 are arranged in the electric pre-engagement actuator 16. The thrust device 160 has a winding 162, and the switching device 161 has a winding 165. The winding 162 of the thrust device 160 and the winding 165 of the switching device 161 each bring about, in the switched-on state, an electro-magnetic field which flows through various components.

Figure 2:
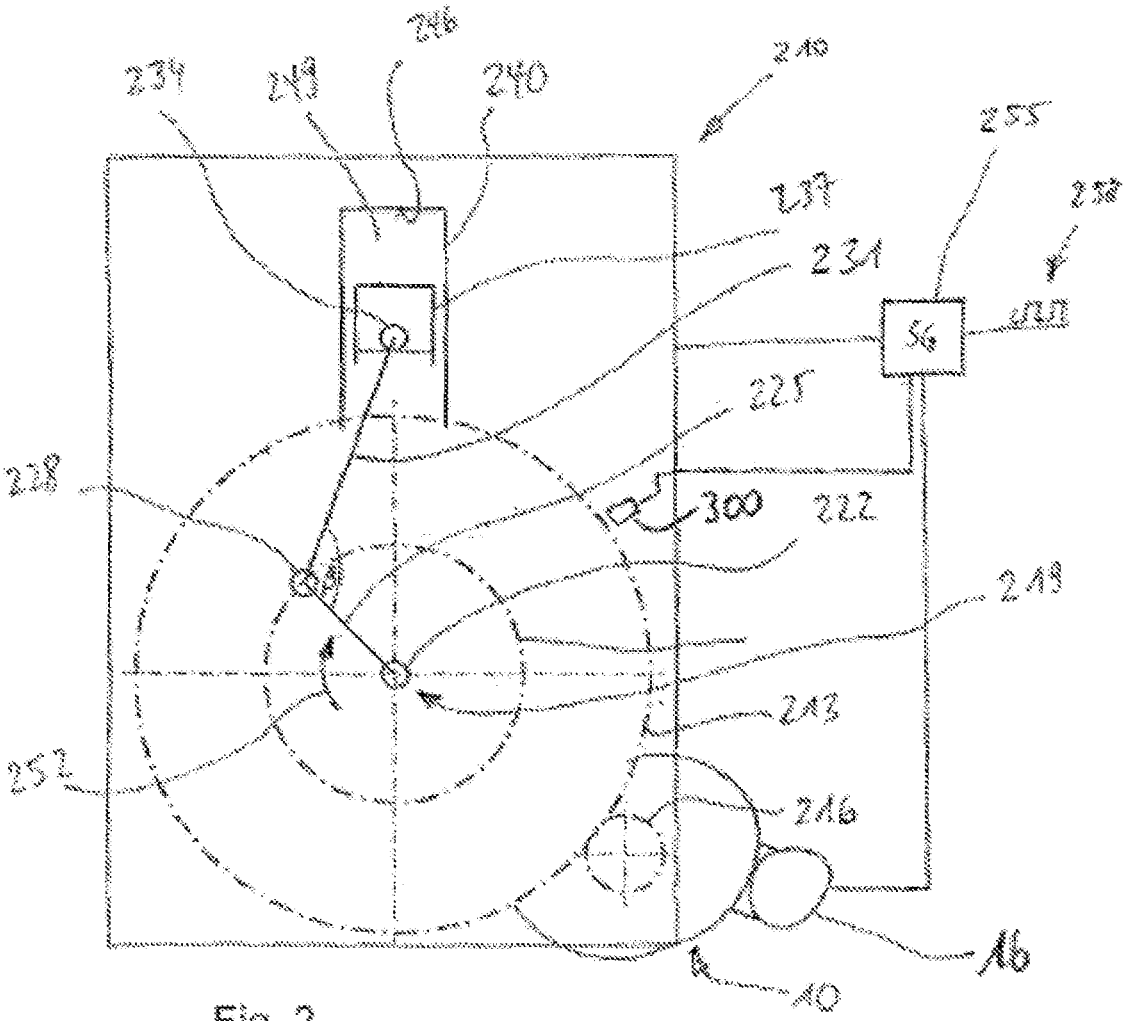
FIG. 2 shows a schematic view of an internal combustion engine with a crank drive.

FIG. 2 illustrates a schematic view of an internal combustion engine 210. This internal combustion engine 210 has the toothed ring 25 (already mentioned), of which what is referred to as a pitch circle 213 is illustrated in FIG. 2. This pitch circle 213 is at a tangent with a further pitch circle 216. While the pitch circle 213 is the pitch circle 213 of toothing of the toothed ring 25, the pitch circle 216 is the pitch circle of the toothing of the starting pinion 22. The pitch circle 216 is not part of the internal combustion engine 210 here, but is illustrated here for the sake of clarity and comprehension. A rotational axis 219 of a drive shaft 222 of the internal combustion engine 210 is illustrated in a center of rotation, which is illustrated here by two intersecting dash-dot lines. This drive shaft 222 is embodied here as what is referred to as a crankshaft. A crank component 225 or crank section starts from a central part of the drive shaft 222 which moves in a purely rotational fashion. A connecting rod 231 is coupled to a lifting journal 228. While one end of the connecting rod 231 is coupled to the lifting journal 228, another end of the connecting rod 231 is coupled to a piston 237 by means of a piston bolt 234. This piston 237 is in turn arranged in a linearly slidable fashion in a cylinder 240. A combustion chamber 249 is located between a piston floor 243 and a surface 246 of a cylinder head (not described in more detail). The arrow 252 (illustrated in FIG. 2) indicates a direction of rotation of the drive shaft 222 in the driven state of the internal combustion engine 210.

Such an internal combustion engine 210 is usually controlled by a control unit 255. If this control unit 255 then receives a signal 258 which communicates to the control unit 255 that the internal combustion engine 210 is to be switched off, for example a fuel supply (not illustrated here) is interrupted so that the internal combustion engine 210 comes to a standstill after a short time. Such a process of coasting to a standstill 261 is illustrated in more detail in FIG. 3.

The time is plotted on the abscissa (x axis), and the rotational speed n is plotted on the ordinate (y axis). Furthermore, two horizontal lines are illustrated, wherein the upper of the two horizontal lines represents a limiting value of a rotational speed of the drive shaft 222, and the lower of the two lines represents a target rotational speed of the drive shaft 222. The target rotational speed is characterized by nZ, and the limiting rotational speed or the upper and therefore highly reliable limiting value of a rotational speed of the drive shaft 222 is denoted by nG. For example, it is assumed here that the target rotational speed nZ corresponds to a value of 80/min, while the limiting rotational speed nG corresponds to a value of 150/min. For the sake of further orientation, the distance between the two vertical lines corresponds to a time difference of 50 ms. For the sake of further orientation, individual specific points of the process of coasting to a standstill are also characterized. Therefore, three points are denoted by UT and a respective serial number 1, 2 or 3. These points UT1, UT2 and UT3 stand for what are referred to as bottom dead centers. The designations OT1 and OT2 correspondingly represent what are referred to as top dead centers 1 and 2. During two revolutions of the drive shaft 222, each piston 237 of an internal combustion engine 210 which is equipped with a plurality of cylinders 240 and accordingly also a plurality of pistons 237, for example a 6-cylinder in-line engine (4-stroke engine), passes through one top dead center OT, at which a connecting rod 231 and a crank component 225 are in the extended arrangement. With respect to FIG. 2, this means that an angle β between the connecting rod 231 and the crank component 225 is precisely 180°. If a piston 237 is at what is referred to as a bottom dead center, the angle β=0. Compared with FIG. 2, the crank component 225 and the connecting rod 231 are therefore congruent over the length of the crank component 225. The lifting journal 228 is then located at its lowest point. In the illustration according to FIG. 3, a bottom dead center UT1, UT2 or UT3 corresponds to a relative maximum on the curve which represents the process of coasting to a standstill 261. A top dead center OT1 or OT2 is represented by a relative minimum on the same curve. The position of the UT and OT is only assumed at the positions of maximum values and minimum values for this example. In fact, an UT and also an OT can be located near to a maximum or a minimum. The respective actual position is dependent, for example, on valve control times, compression states and other influences. The latter also include, for example, the influence of the load generated at the generator when said generator is coupled, as is customary, to the internal combustion engine 210 via a belt drive.

Since in the case of a 6-cylinder in-line engine the two crank components 225 are usually arranged in a plane and there are a total of three such planes which are spaced apart by respectively 120° (degrees of angle) from one another, this means that the distance between UT1 and OT1 corresponds to 60°. After a further 60°, two further pistons 237 assume a bottom dead center UT2, and after a further 60° two other pistons 237 assume a top dead center OT2, etc.

Figure 3:
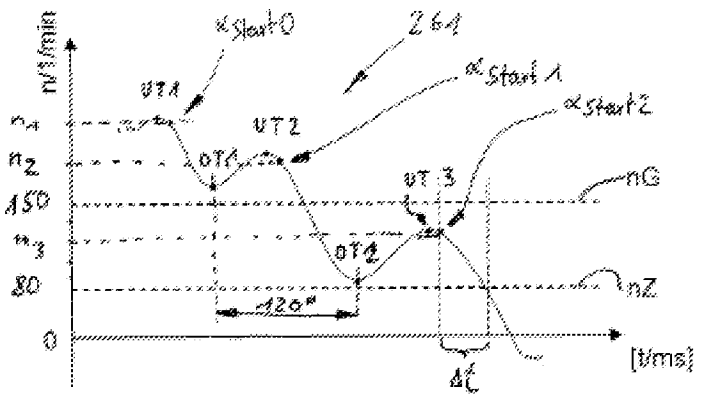

Within the context of the methods and method steps presented in total here, there is provision for the starting pinion 22 of the starter device 10 to mesh with the internal combustion engine 210 which is coasting to a standstill, and therefore with the rotating toothed ring 25 thereof. For this purpose, during the process of coasting to a standstill, the engine speed n of the internal combustion engine 210, the crankshaft angle $\alpha$ and the time t are measured. The time t is obtained here, for example, from a clock in the control unit starting from a specific starting point, or, for example, the number of oscillations of a quartz is counted and multiplied by the oscillation time in order to determine the time difference $\Delta t$ between a starting time $t=0$ and a later time $t\neq 0$. The crankshaft angle $\alpha$ is determined, for example, by a sensor 300. For this purpose, for example on the basis of a quite specific determined signal, the sensor 300 (angle sensor or rotational speed sensor) determines each further position of the drive shaft 222 using a perforated grid, provided on the toothed ring 25 or flywheel (not shown in more detail here) for detecting the angular position of the drive shaft 222 any further angular position. An engine speed n between different crankshaft angles $\alpha$ is generally determined by what is referred to as the angular speed, i.e. the change in the angle $\alpha$ and therefore in the crankshaft position or drive shaft position between two different angles $\alpha 1$ and $\alpha 2$ as well as the time $\Delta t = t2 - t1$ which has passed in the meantime. The observation time period can for this purpose be restricted, for example, to the distance between adjacent top dead centers, i.e. to the value range with the cylinder number $i_{Cylinder}$ of the internal combustion engine 210. The value range is then obtained on the basis of two revolutions of the drive shaft 222 which correspond to a passed-through angle of 720 degrees angle, and to the number of cylinders $i_{Cylinder}$ for the angle or the value range thereof between the angle 0° and the angle $720°/i_{Cylinder}$. In the example with an in-line 6-cylinder engine, the value range comprises 120 degrees angle. If in the process the rotational speed n undershoots a rotational speed limit nG in the case of a specific, defined angle $\alpha_{Start}$, the meshing process should be begun. This means that after the detection according to which the drive shaft 222 is smaller at $\alpha_{Start}$ than the rotational speed limit nG, the starting pinion 22 is to be pre-engaged in the direction of the toothed ring 25. If FIG. 3 is considered, it is apparent that for the angle $\alpha_{Start1}$ applies, according to which this angle $\alpha_{Start1}$ corresponds here, for example, to an angle of 10° after a bottom dead center, here the bottom dead center UT2. As is readily apparent, for the angle range or value range of 120° between OT1 and OT2 it becomes immediately clear that the rotational speed value n2 ($\alpha_{Start1}$) is approximately 180/min. The value n2 is therefore higher than nG. The condition is accordingly not met. By passing through the next value range starting from OT2, it is detected at the next value of 10 angular degrees after a bottom dead center UT, here UT3, that the value n3 ($\alpha_{Start2}$)=120/min. The comparison with the predefined rotational speed value nG=150/min shows that the rotational speed at the angular position $\alpha_{Start2}$ is smaller than the predefined rotational speed value nG. The fact that this condition is met is now a reason for the system to generate a signal in order to pre-engage the starter device 10 and therefore the starting pinion 22 in the direction of the toothed ring 25. The method is configured here in such a way that the meshing pinion 22 is to be pre-engaged in the direction of the toothed ring 25 even if the rotational speed value n3 ($\alpha_{Start2}$) is equal to the predefined rotational speed value nG.

Accordingly, a method for actuating a starter device 10 is disclosed, wherein the starter device 10 has a starting pinion 22 which is provided to be meshed with a toothed ring 25 of an internal combustion engine 210, wherein the internal combustion engine 210 has a drive shaft 222. During the sequence of the method, there is provision here that firstly a rotational speed n, n1, n2, n3 of the drive shaft 222 is detected, this detected rotational speed n, n1, n2, n3 is compared with a predefined rotational speed value nG, and if the rotational speed n, n1, n2, n3 is lower than or equal to or at most equal to or not greater than the predefined rotational speed value nG, the starting pinion 22 is pre-engaged in the direction of the toothed ring 25. For the sake of completeness it will be mentioned here that, at the point at the angular position $\alpha_{Start0}$ which is just after when a bottom dead center UT1 is passed through, the drive shaft 222 has the rotational speed n1. N gives the rotational speed of the drive shaft 222 in general.

Figure 4:
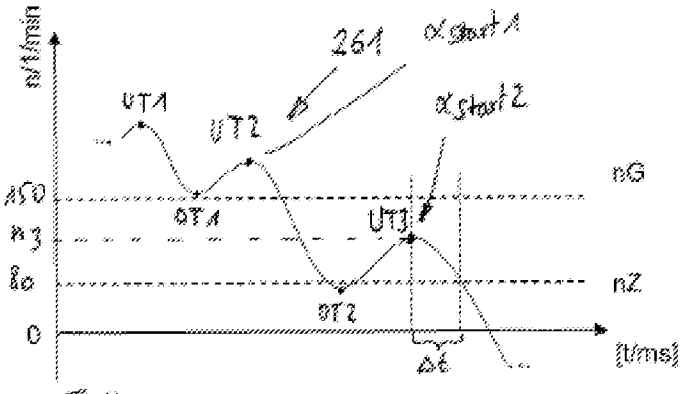

FIG. 4 illustrates a similar diagram to that in FIG. 3. In contrast to the illustration according to FIG. 3, the process 261 of coasting to a standstill which is illustrated there is illustrated somewhat differently from that in FIG. 3. In this case, the rotational speed level of this curve is somewhat lower, which can be detected, for example, at the position of the top dead center OT2. This top dead center OT2 is somewhat below the target rotational speed nZ here. In the example, the angle $\alpha_{Start2}$ is arranged precisely at a position of the bottom dead center UT3. The sequence according to this process 261 of coasting to a standstill is precisely like that according to FIG. 3. The rotational speed of the drive shaft 222 which is detected at the angular position $\alpha_{Start1}$ at UT2 is higher than the predefined rotational speed value nG. At the next bottom dead center UT3, the rotational speed value n3 is lower than the predefined rotational speed value nG, with the result that in this case the starting pinion 22 is then pre-engaged in the direction of the toothed ring 25. This pre-engagement occurs in turn during the time section $\Delta t$, with the result that in this case also the starting pinion 22 meshes with the toothed ring at the desired rotational speed nZ. A target rotational speed nZ is a rotational speed of the drive shaft 222 at which the starting pinion 22 is intended to mesh, wherein an actuation time $\Delta t$ is a time difference between an application time tZ and the starting time.

Figure 5:
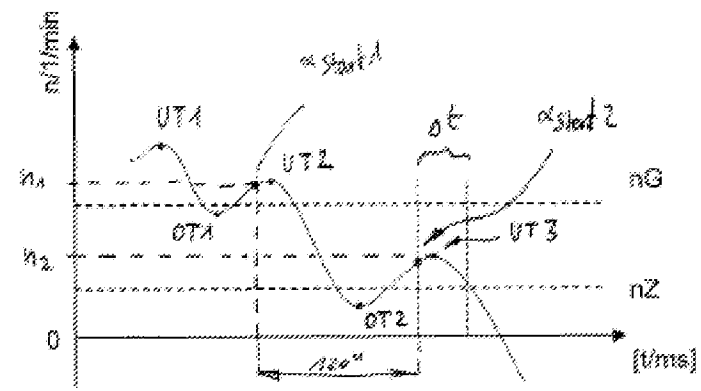
Figure 4:
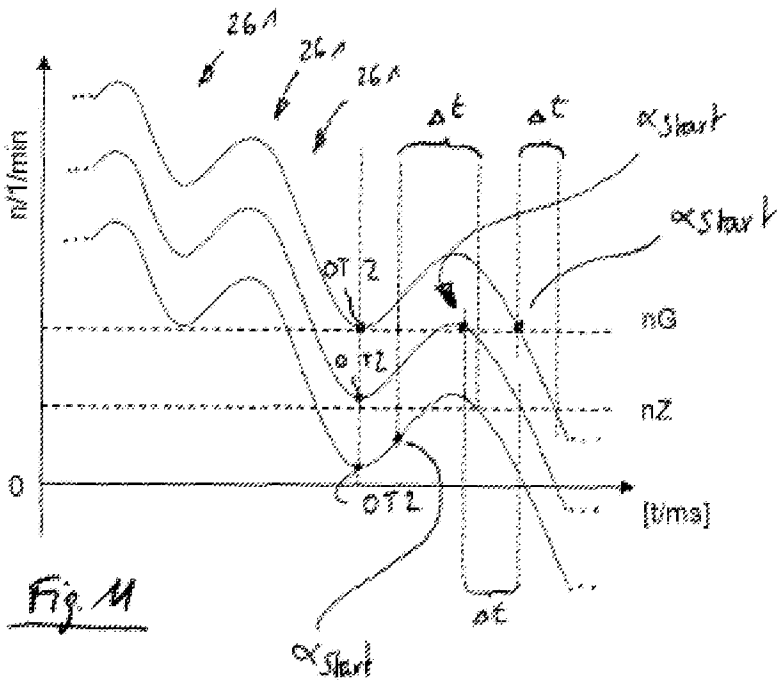
Figure 3:
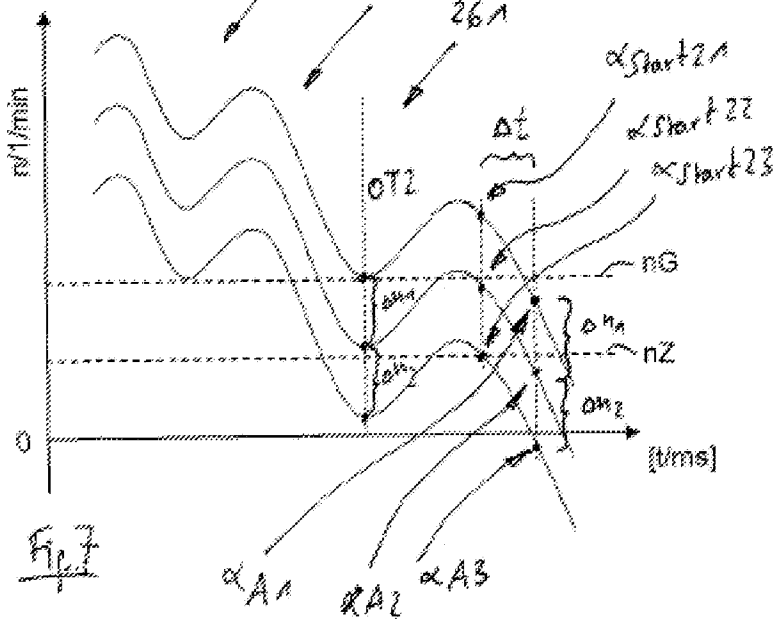

In the example according to FIG. 5, the process 261 of coasting to a standstill is still lower, i.e. for example for the top dead center OT2 its rotational speed is still lower than in the illustration according to FIG. 4. Here too, when the drive shaft 222 assumes the angular position $\alpha_{Start1}$, a rotational speed of the drive shaft 222 which is above the rotational speed or the rotational speed value nG is detected. The following rotational speed value of the drive shaft 222 after a further 120° change in rotational position of the drive shaft 222 at $\alpha_{Start2}$ is in turn between the predefined rotational speed value nG and the target rotational speed nZ, with the result that the starting pinion 22 is subsequently pre-engaged in the direction of the toothed ring 25 and as a result in this case the starting pinion 22 meshes with the toothed ring 25 approximately when the latter has the target rotational speed nZ.

Figure 6:
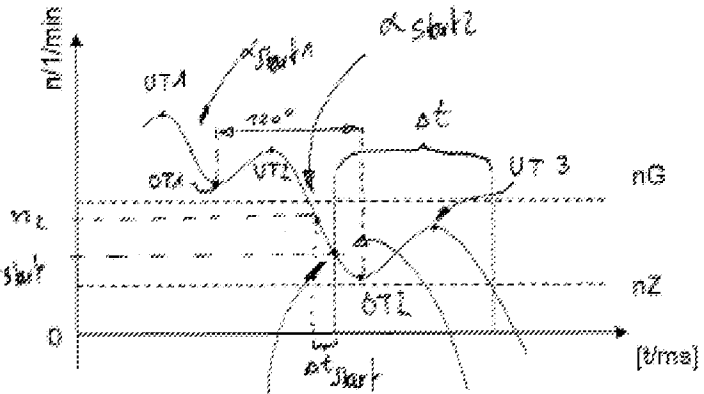

In FIG. 6, various properties are different from in the previously mentioned examples. In this example, for example the period Δt is significantly longer than in the other exemplary embodiments. This means here in this case that the time which the starting pinion 22 takes to at least pre-engage at the toothed ring 25 is significantly longer, here approximately three times as long, as in the other exemplary embodiments. However, the differences are even greater here: on the one hand the angle α at which the rotational speed n of the drive shaft 222 is determined is approximately centrally between a bottom dead center UT and a top dead center OT (approximately at the turning point of the process 261 of coasting to a standstill) and on the other hand a starting time $t_{Start}$ differs from the time at which the drive shaft 222 assumes the angular position $\alpha_{Start2}$. As in the other exemplary embodiments, a rotational speed n or n1 is determined in advance at the angular position $\alpha_{Start1}$, and in this case, as in the other exemplary embodiments, it is detected that this rotational speed value is too high compared with the rotational speed nG. After a further 120° have passed, and therefore at the angular position $\alpha_{Start2}$, a rotational speed n2 is determined which is lower than the predefined rotational speed value nG. As a result of this condition which is fulfilled, according to the proposed method the starting pinion 22 is pre-engaged in the direction of the toothed ring 25. However, in this particular case the actual active pre-engaging process does not start until a time $t_{Start}$, which is after the time when the drive shaft 222 assumes the angular position $\alpha_{Start2}$. This is because, within the scope of the method, there is provision for the starting pinion 22 to be preferably applied to the toothed ring 25 at the target rotational speed nZ, and preferably also to be meshed with the toothed ring 25 then. The time at which the decisive rotational speed nStart is determined and the time tStart at which the starting pinion 22 begins to pre-engage are not identical.

According to a further refinement of the invention, the crankshaft angle or drive shaft angle $\alpha_{Start}$ at which the meshing process is intended to begin can be defined, for example, by what is referred to as a characteristic diagram. Consequently, for example when the condition which is to be met has occurred at the angular position $\alpha_{Start2}$, it is possible to define, as a function of the actual rotational speed value at this moment at this angular position $\alpha_{Start2}$, that the starting process is to begin when the angle $\alpha_{Start}$ is reached. Alternatively, instead of the time period starting at the time at which the drive shaft 222 meets the condition, the process can also start, for example, after a further time period of $\Delta t_{Start}$. According to a further alternative, after the assumption of the angle $\alpha_{Start2}$ by the drive shaft 222, the starting process or the pre-engagement process can also be initiated after the drive shaft 222 has reached a rotational speed $n_{Start}$.

For a process 261 of a drive shaft 222 coasting to a standstill, as is illustrated in FIG. 6, the actuation time Δt is selected in such a way that after the start of the actuation of the starter as a result of the starting angle $\alpha_{Start2}$ being passed through, where $n2=n(\alpha_{Start2})$ is smaller than nG, a top dead center OT2 is passed through. In this case, for the method to run satisfactorily, it must be ensured that a premature swinging-back movement can be prevented under all operating conditions which occur and with all the engine properties which occur. Such a premature swinging-back movement would lead to the starting pinion 22 of the starter device 10 not meshing with the toothed ring 25 until the internal combustion engine 210 is in a stationary state. This should be carried out quite particularly when the expected deviation of the rotational speed of the drive shaft 222 of the internal combustion engine 210 from the rotational speed nZ is not tolerable. This applies quite particularly to swinging back of the drive shaft 222.

FIG. 7 illustrates three different processes 261 of coasting to a standstill. These three processes of coasting to a standstill have different rotational speed levels. The process 261 of coasting to a standstill with the highest rotational speed level differs from the next lowest process 261 of coasting to a standstill illustrated here at least in the position OT2 with a difference in rotational speed of Δn1. This ultimately middle process 261 of the rotational speed coasting to a standstill differs from the process 261 of coasting to a standstill with the lowest rotational speed level with the difference in rotational speed of Δn2. In these three exemplary profiles, for the purposes of comparison, the angle α at which a pre-engagement actuator 16 actually brings about a thrust movement of the starting pinion 22 is always at the same angular position $\alpha_{Start1}=\alpha_{Start22}=\alpha_{Start23}$. As is assumed according to the description relating to FIG. 6, the starting pinion 22 pre-engages and bears against the toothed ring after a time profile Δt. In the three cases outlined, the angular speed of the drive shafts 222 is different here. The uppermost profile 261 with the highest rotational speed level at $\alpha_{Start23}$ therefore has the rotational speed of the drive shaft 222 a value which is between the rotational speed nZ and nG, but this rotational speed is in addition significantly higher than nZ.

In the second case (middle rotational speed level), for example the actual rotational speed at which the starting pinion 22 bears against the toothed ring 25 is already below the target rotational speed nZ which is defined per se. In the case of the coasting-to-a-standstill curve 261 at the lowest rotational speed level, it is even the case that the starting pinion 22 does not bear against the toothed ring 25 until the drive shaft 222 has swung back in the combustion chamber 249 (compression stroke) owing to the "pneumatic spring forces" before a top dead center is reached. Furthermore, for the same of comprehension of this FIG. 7, it is noted that the abscissa does not represent a fixed scale here. The specification of a time difference Δt here constitutes only a specification of a general time difference. The time difference Δt is absolutely different in each case. It is therefore possible, as illustrated in FIG. 7, for deviations to occur in the actual meshing rotational speed. These deviations may be positive, i.e. the meshing rotational speed or rotational speed at which the starting pinion 22 bears against the toothed ring 25 may be higher than the rotational speed nZ, but it can also be lower than the rotational speed nZ. The meshing rotational speed of the drive shaft 222 nZ can even be negative compared to the customary direction of rotation of the drive shaft 222 (in the case of driving).

If deviations in rotational speed occur between the actual rotational speed of the internal combustion engine and the drive shaft 222 thereof and the rotational speed nZ outside permissible tolerances for a specific type of internal combustion engine 210 when meshing with the internal combustion engine 210 which is coasting to a standstill takes place and/or when the starting pinion 22 is applied to the toothed ring 25 of the internal combustion engine 210, the method which is described below can alternatively be used.

Figure 9:
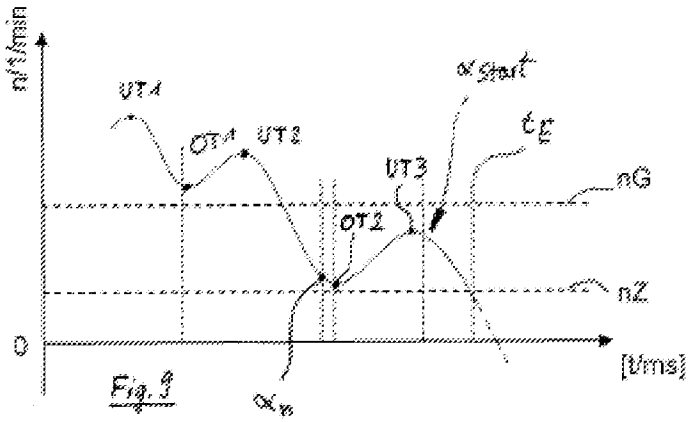
Figure 8:
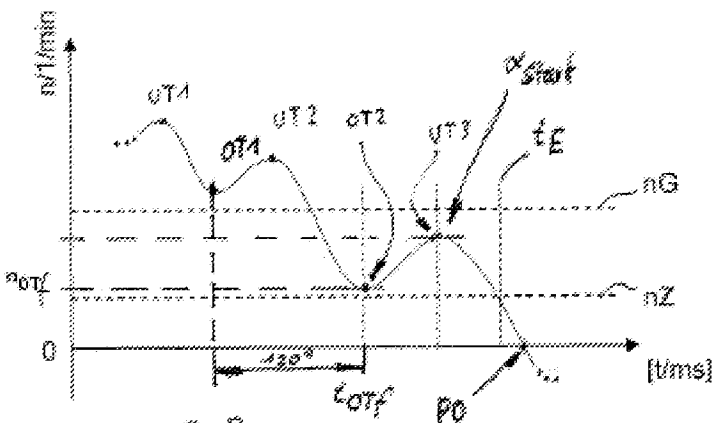
Figure 10:
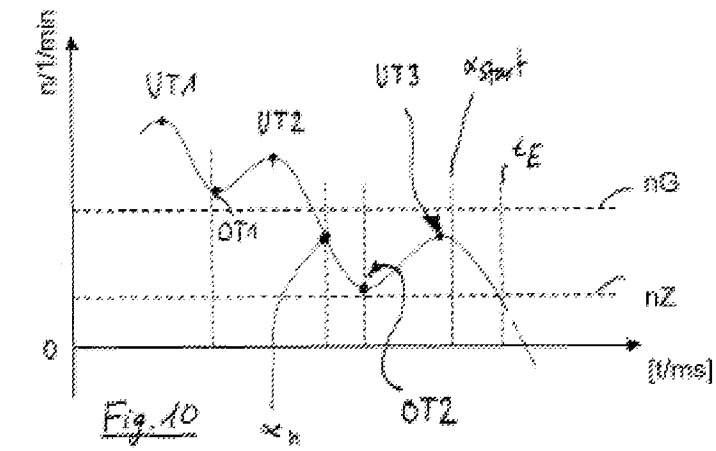

FIGS. 8, 9 and 10 once more illustrate three processes 261 of coasting of the internal combustion engine 210 to a standstill. According to FIG. 8, at the top dead center OT2 which in terms of its rotational speed is lower than or equal to the rotational speed nG, the rotational speed of the drive shaft 222 is analyzed. Since the kinetic and the potential energy of the internal combustion engine 210 stored by the compression of the gas located in the combustion chamber 249 is not sufficient to overcome a further top dead center in the forward direction under the given operating conditions, the drive shaft 222 at the point P0 comes to a standstill for a moment before then swinging back (rotational oscillation of the drive shaft 222). Any rate, the drive shaft 222 would have such a movement behavior at least when the starting pinion 22 would not mesh with the toothed ring 25 or would be applied to the toothed ring 25. The time at which the internal combustion engine 210 reaches the last top dead center OT2 is the time tOTf. The rotational speed at this moment is nOTf. According to the definition, after the angle $\alpha_{Start}$ has been reached, the meshing process is then started in order ideally to mesh with the internal combustion engine 210 at the target rotational speed nZ, and to do this at the time tE. Within the scope of the method sequence, there is also provision here that, during the process 261 of coasting to a standstill by the internal combustion engine 210, the rotational speed n of the internal combustion engine 210, the instantaneous angle α of the drive shaft 222 and the time t which has passed are recorded. The value range of α is limited here, for example, to the distance between two adjacent dead centers, wherein this distance between two adjacent top dead centers is assumed to be limited to the value range between 0 degrees and the quotient formed between 720 degrees and the number i of cylinders of the internal combustion engine 210. In the example, that is to say in the case of an internal combustion engine 210 with an in-line 6-cylinder engine, the value range is therefore limited to a range between 0 degrees and 120 degrees. If, during a process 261 of coasting by the internal combustion engine 210 to a standstill, the rotational speed nOTF of a top dead center OT2≤nG, i.e. is at most as large as a previously determined limiting rotational speed nG, the internal combustion engine 210 is, with its mass inertia under the given operating parameters, energetically not capable of overcoming a further top dead center OT in the forward movement (i.e. the driving direction of the drive shaft 222). The mass inertia or the moment of mass inertia J takes into account here, for example, the inertia of the drive shaft 222, the inertia of the connecting rod 231, the mass inertia of the pistons 237 and, of course, also the mass inertia of the toothed ring 25 and of other parts such as camshafts, valves, coupled belt drives and the rotational masses, such as for example a generator, which are driven thereby. The limiting rotational speed nG is assumed to be constant as in the case of constant operating conditions of the internal combustion engine 210 for various processes 261 of engines coasting to a standstill. However, if the operating conditions and therefore, for example, the parameters such as the temperature (oil temperature, cooling water temperature, engine compartment temperature, temperature of the sucked-in or fed-in combustion air, the engine friction, the pressure in the inflow section (intake manifold/pressure manifold) in the case of self-induced or supercharged engines) change, the limiting rotational speed nG is changed. The respective limiting rotational speed nG can be stored here for the different parameters in a storage table. If no precise value is available for individual parameters, corresponding intermediate values can be determined by customary calculation methods (interpolation, extrapolation).

As is apparent from FIGS. 9 and 10, still other points of the process 261 of coasting to a standstill by the engine can be used in order to decide, on the basis of the respective current rotational speed, whether the rotational speed is less than or equal to the predefined rotational speed value nG.

According to the example in FIG. 9, an angle αn is used which the drive shaft 222 passes through, in order to decide whether the movement state of the drive shaft 222 meets the criterion according to which the rotational speed n is n≤nG given the assumption of the angle αn meets the condition. As is already the case in the previous exemplary embodiment, the starting pinion 222 is then pre-engaged after the starting angle $\alpha_{Start}$ is reached, in order then to be applied to the toothed ring 25 at the time tE, or to then mesh therewith.

In the exemplary embodiment according to FIG. 10, the angle αn is in the vicinity of the turning point between the bottom dead center UT2 and the top dead center OT2. Here too, the starting pinion 22 is then pre-engaged if necessary, i.e. after the rotational speed nG has been undershot when the angle $\alpha_{Start}$ has been reached, in order then to bear against the toothed ring 25 at the time tE or to mesh therewith.

The limiting rotational speed nG itself can be defined by means of a suitable method. As already mentioned, said limiting rotational speed nG can be stored, for example, in a characteristic diagram as a function of the operating parameters which occur, on which details have already been given above. The rotational speed nG can be determined during the process 261 of coasting to a standstill by the engine, for example by considering the energy. Furthermore, the rotational speed nG can also be determined by means of a learning function by taking into account processes of coasting to a standstill by the engine which have already been recorded.

If the rotational speed n at the top dead center OT2 is not higher than nG, the meshing process is to be started from the time when the crankshaft angle $\alpha_{Start}$ is reached (FIG. 8). The same applies to the meeting of the rotational speed conditions with respect to the points which are satisfied at the crankshaft angles αn, FIG. 9 and FIG. 10.

On the basis of an example according to FIG. 11 it is explained how the starting angle $\alpha_{Start}$ can be selected in order to mesh at the target rotational speed nZ. In this case, this example is described as a function of the rotational speed at the top dead center OT2. However, this selection can also readily be transferred to the examples according to FIG. 9 and FIG. 10. In FIG. 11, in turn three processes 261 of coasting to a standstill are illustrated. The high-speed process 261 of coasting to a standstill has a rotational speed n at the top dead center OT2, which is equal to the rotational speed nG. In view of this high rotational speed level, the starting pinion 22 is pre-engaged in the direction of the toothed ring 25 only relatively late when the angle $\alpha_{Start}$ is reached. In all three cases described in FIG. 11, it is also assumed that the ideal target rotational speed nZ is reached. In the case of the somewhat lower, middle process 261 of coasting to a standstill, the starting pinion 22 starts the pre-engagement of the drive pinion 22 at a different starting angle $\alpha_{Start}$ compared to the previously described exemplary embodiment. Furthermore, the term "earlier" is not to be understood in the sense of time. Earlier means here that the starting angle $\alpha_{Start}$ is geometrically closer to the top dead center OT2 or closer to the angle α which represents a crankshaft position or drive shaft position at which a piston 237 is in the position OT2. In the case of the coasting-to-a-standstill curve shown in the example which has the lowest rotational speed level, the starting angle α start is still closer to the position OT2.

If in this method to the starting angle $\alpha_{Start}$ were to be left unchanged independently of the rotational speed level of the coasting-to-a-standstill curve 261, see, for example, FIG. 7, the expected maximum rotational speed deviation Δn or Δn1 and Δn2 would occur during the meshing of the starting pinion 22 with the toothed ring 25, or during the application of said starting pinion 22 against the latter, even as a result of the present method given a constant characteristic for the coasting of the engine to a standstill. Starting from the crankshaft angle or drive shaft angle $\alpha_{Start}$ ($\alpha_{Start21}$, $\alpha_{Start22}$, $\alpha_{Start23}$), the starter device or a pre-engagement actuator would then be actuated in order to mesh at a target rotational speed nZ at a respective different time tE. At this point it is to be noted that the time tE for each coasting-to-a-standstill curve 261 is a different time. With such a method, the target rotational speed nE would not be a rigid target rotational speed nZ but rather a target rotational speed nZ which in this example fluctuated about a mean value, with a rotational speed difference Δn. The fluctuation range would then correspond approximately to half the limiting rotational speed nG.

Even given a constant characteristic of the coasting of the engine to a standstill or the process 261 of the coasting to a standstill, i.e. essentially constant average gradients for the coasting of the engine to a standstill and changes in rotational speed due to cylinder compression and cylinder decompression, with this method the actual meshing rotational speed would vary by a differential rotational speed Δn. Given a constant actuation time of the starter motor or of the starting pinion 22, the starting angle $\alpha_{Start}$ can be adapted on the basis of the rotational speed of one or more characteristic points, for example the rotational speed of the last top dead center nOT2. One possible method for adaptation is here the storage of a characteristic diagram for different rotational speeds at each top dead center OT or the recalculation of $\alpha_{Start}$ by means of a learning function.

In the event of the process of the engine coasting to a standstill (process 261) being set differently, for example over the profile of the technical service life of the internal combustion engine 210 or, for example, of state variables which influence the process 261 of coasting to a standstill during this time, in the present method result in a deviation between the actual meshing rotational speed nE and the target rotational speed nZ. A change in the characteristic of the process 261 of coasting to a standstill can therefore be divided into two types:

Variation of the average gradient for the coasting of the engine to a standstill The average gradient for the coasting of the engine to a standstill can be varied, for example, by changing the friction, the loads effective during the coasting of the engine to a standstill and the temperatures of further parameters. If appropriate, the limiting rotational speed nG and/or the starting angle $\alpha_{Start}$ should be adapted by means of the variation. The spread of these parameters can be tested by means of vehicle dimensions under various operating conditions and for different consumers, and limiting situations can be analyzed by means of engine simulations.

Changes in the Engine Ripple

Changes in the engine ripple are changes in the rotational speed caused by cylinder compression and cylinder decompression. This ripple, for which a suitable starting angle $\alpha_{Start}$ is selected by means of a suitable method, is varied, for example, by the cylinder stroke and leakage. Cylinder properties of a defined type of engine can be influenced by operating conditions, series production spread and aging effects.

Figure 12:
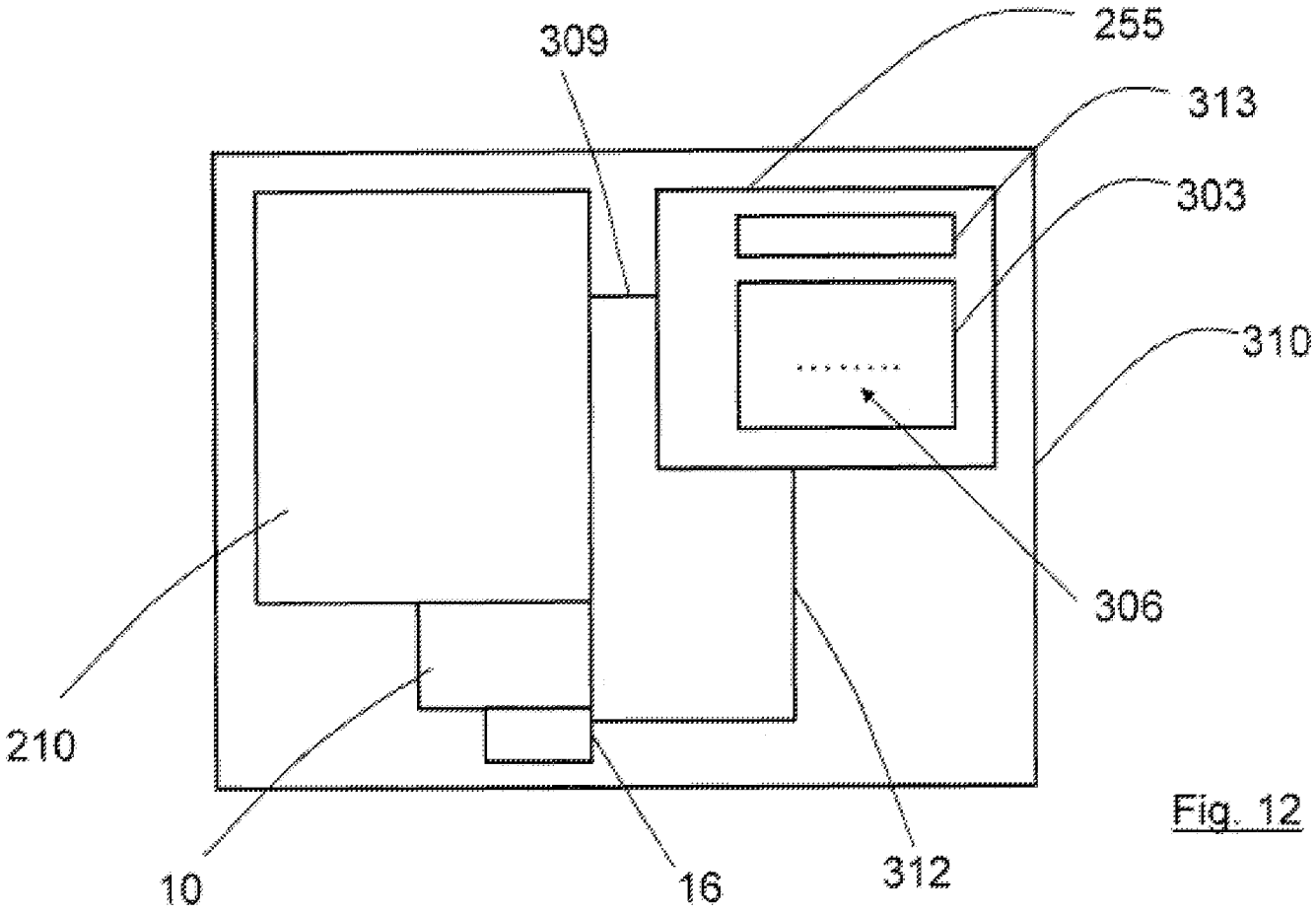

For the sake of providing an overview, FIG. 12 shows a schematic illustration of a motor vehicle 310 with the internal combustion engine 210, the starter device 10, the pre-engagement actuator 16, a control unit 255 with a processor 313 and a program memory 303. Systematically associated program instructions 306 (computer program product) are stored in the program memory 303, and permit the method described here to be carried out according to one of the refinements described here. The control unit 255 is connected by means of a connecting device 309 (for example cable) to the internal combustion engine 210 which permits, for example, the transmission of signals of the rotational speed sensor 300 to the control unit 255. A connecting device 312 serves to actuate the pre-engagement actuator 16, according to which a suitable starting time tStart is determined.

According to the exemplary embodiments above, the rotational movement of the drive shaft 222 is characterized by a very dynamic profile. In macroscopic terms, the rotational speed drops. However, this profile is characterized by relative minimum values in the vicinity of top dead centers and relative maximum values in the vicinity of bottom dead centers. Furthermore, the profile therefore has positive gradient values (between the top and bottom dead centers) and negative gradient values (between the bottom and top dead centers).

The program instructions 306 (computer program product) can, for example, be loaded into the program memory 303 via an interface (for example plug-type connection).

A computer program product is therefore disclosed which can be loaded into at least one program memory 303 with program instructions 306 in order to permit all the steps of the method to be carried out according to one of the refinements described here if the program is executed in at least one control unit 255.

FIG. 12 shows a control unit 255 for a start/stop operation of an internal combustion engine 210 in a motor vehicle 310 for briefly stopping and starting the internal combustion engine 210, wherein the internal combustion engine 210 can be started by means of an electric starter device 10, wherein the control unit 255 has a processor 313 with a program memory 303. The processor 313 is embodied as a detection device, evaluation device and control device in order to actuate the starter device 10 in a defined fashion, wherein a computer program product as mentioned above is loaded into the program memory 303 in order to carry out a method according to one of the steps described above.

There is provision for the method steps described above to be used in a motor vehicle which is equipped with a start/stop method of operation. The start/stop method of operation permits automated meshing of the starting pinion 22 as soon as the control unit 255 receives a signal 316 from a triggering device 319 which represents a desire of the vehicle driver to carry on driving with the motor vehicle. The triggering device 319 may be what is referred to as a clutch pedal or an accelerator pedal or a shifting operator control component which is used to select a gearbox stepup ratio or gearbox reduction ratio in transmissions (gearbox between the clutch and driven wheel or wheels).

The invention claimed is:

1. A method for actuating a starter device (10), wherein the starter device (10) has a starting pinion (22) which is provided to be meshed with a toothed ring (25) of an internal combustion engine (210), wherein the internal combustion engine (210) has a drive shaft (222), the method comprising:

a. detecting firstly a rotational speed (n, n1, n2, n3) of the drive shaft (222) in a previously determined position with a specific angle (an, aOT, aUT), b. comparing the detected rotational speed (n, n1, n2, n3) with a predefined rotational speed value (nG), and c. initiating the pre-engagement of the starting pinion (22) in the direction of the toothed ring (25) if the rotational speed (n, n1, n2, n3) is lower than or equal to the predefined rotational speed value (nG) and a further predefined condition (nStart, tStart, aStart) is met;

wherein the further predefined condition is reaching a further specific angular position or a further predefined rotational speed value.

2. The method as claimed in claim 1, characterized in that the drive shaft (222) is a crankshaft which is coupled to a piston (237) by a connecting rod (231), wherein the position (a) of the drive shaft (222) is such that a piston (237) assumes a top dead center (OT) or a bottom dead center (UT).

3. The method as claimed in claim 1, characterized in that the event (nStart, tStart, aStart) is determined as a function of at least one operating condition.

4. The method as claimed in claim 1, characterized in that, during a process of coasting to a standstill by the internal combustion engine, the rotational speed (n), the associated angle (α) of the drive shaft (22) and an associated time (t) are recorded.

5. The method as claimed in claim 1, characterized in that a predefined rotational speed value (nG) is dependent on a temperature.

6. The method as claimed in claim 1, characterized in that a starting angle (αStart) is an angle (α) at which the current rotational speed (n) is lower than a previously defined rotational speed (nG).

7. The method as claimed in claim 1, characterized in that the previously defined rotational speed (nG) is a rotational speed below which the crankshaft CS will assume a target rotational speed (nZ) after a subsequent angular position (α) has been passed through.

8. The method as claimed in claim 1, characterized in that a starting angle (αStart) is determined as a function of a rotational speed (n) at a specific angle (α).

9. The method as claimed in claim 1, characterized in that the starting angle (αStart) is obtained from a characteristic diagram, and the starting angle (αStart) is stored in the characteristic diagram as a function of a rotational speed (n) at a specific angle (α).

10. The method as claimed in claim 1, characterized in that, when the starting rotational speed (nStart) is reached, the starting pinion (22) of the starter device (10) is pre-engaged in the direction of the toothed ring (25).

11. The method as claimed in claim 1, characterized in that a starting time (tStart) coincides with the start of a flow of current through a pre-engagement actuator (16) which leads to a thrust movement of a magnetic armature (168) in the pre-engagement actuator (16).

12. The method as claimed in claim 1, characterized in that a target rotational speed (nZ) is a rotational speed of the drive shaft (222) at which the starting pinion (22) is intended to mesh, wherein an actuation time (Δt) is a time difference between an application time (tZ) and the starting time.

13. A non-transitory computer readable medium having a computer program product which can be loaded into at least one program memory (303) with program instructions (306) in order to carry out all the steps of:

a. detecting firstly a rotational speed (n, n1, n2, n3) of the drive shaft (222) in a previously determined position with a specific angle (an, aOT, aUT), b. comparing the detected rotational speed (n, n1, n2, n3) with a predefined rotational speed value (nG), and c. initiating the pre-engagement of the starting pinion (22) in the direction of the toothed ring (25) if the rotational speed (n, n1, n2, n3) is lower than or equal to the predefined rotational speed value (nG) and a further predefined condition (nStart, tStart, aStart) of reaching a further specific angular position or a further predefined rotational speed value is met;

when the program is executed in at least one control unit (255).

14. A control unit for a start/stop operation of an internal combustion engine (210) in a motor vehicle (310) for briefly stopping and starting the internal combustion engine (210), wherein the internal combustion engine (210) can be started by an electric starter device (10), wherein the control unit (255) has a processor (313) with a program memory (303), characterized in that the processor (313) is embodied as a detection device, evaluation device and control device in order to actuate the starter device (10) in a defined fashion, having a computer program loaded into the program memory (303) which carries out the steps of:

a. detecting firstly a rotational speed (n, n1, n2, n3) of the drive shaft (222) in a previously determined position with a specific angle (an, aOT, aUT), b. comparing the detected rotational speed (n, n1, n2, n3) with a predefined rotational speed value (nG), and c. initiating the pre-engagement of the starting pinion (22) in the direction of the toothed ring (25) if the rotational speed (n, n1, n2, n3) is lower than or equal to the predefined rotational speed value (nG) and a further predefined condition (nStart, tStart, aStart) of reaching a further specific angular position or a further predefined rotational speed value is met.

15. The method as claimed in claim 1, characterized in that a predefined rotational speed value (nG) is dependent on an engine friction.

16. The method as claimed in claim 1, characterized in that a predefined rotational speed value (nG) is dependent on a pressure.

17. The method as claimed in claim 5, characterized in that the temperature is one of a cooling water temperature, an oil temperature, and an external temperature.

18. The method as claimed in claim 1, characterized in that the specific angle (α) is a function of the angle (α) at which the drive shaft (22) assumes the last top dead center (OT).

* * * * *